US006167845B1

(12) United States Patent
Decker, Sr.

(10) Patent No.: US 6,167,845 B1
(45) Date of Patent: Jan. 2, 2001

(54) INSTANTANEOUS WATER HEATER

(76) Inventor: Robert C. Decker, Sr., P.O. Box 467, Sheridan, MT (US) 59749

( * ) Notice: Under 35 U.S.C. 154(b), the term of this patent shall be extended for 0 days.

(21) Appl. No.: 09/431,147

(22) Filed: Nov. 1, 1999

(51) Int. Cl.[7] ..... F22B 27/00

(52) U.S. Cl. ..... 122/40; 122/14.1; 122/235.17; 392/401; 392/491

(58) Field of Search ..... 122/14.1, 14.22, 122/14.3, 14.31, 15.1, 28, 40, 41, 235.17; 392/399, 400, 401, 491

(56) References Cited

U.S. PATENT DOCUMENTS 3,315,735 * 4/1967 Stanko ..... 122/15.1
3,351,130 * 11/1967 Lowe ..... 122/15.1
3,389,692 * 6/1968 Johnson et al. ..... 122/41
4,455,475 * 6/1984 Giorgetti ..... 392/494

* cited by examiner

*Primary Examiner*—Denise L. Ferensic
*Assistant Examiner*—Gregory A. Wilson

(57) ABSTRACT

An instantaneous water heater comprises a sealed enclosed tank having a top portion, a bottom portion, a first end, and a second end, and an inlet, a baffle tube, and a baffle segregating said tank into a baffle chamber and a main heating and storage chamber. The baffle chamber receives unheated water from said baffle tube. The baffle has baffle openings between said baffle chamber and said main heating and storage chamber providing for intermixing of water therebetween. The tank has a plurality of heating elements and a plurality of temperature sensors and activators. The main heating and storage chamber has an outlet and a safety valve attached thereto, said outlet discharging heated water from said tank and being located in said top portion of said first end of said tank and said safety valve preventing over-heating and over-pressurization in said tank.

10 Claims, 3 Drawing Sheets

INSTANTANEOUS WATER HEATER

BACKGROUND OF THE INVENTION

1. Field of the Invention

The present invention relates to water heaters, and more particularly to an instantaneous water heater assembly designed to provide instantaneous hot water and to heat a continuous supply of water.

2. Description of the Prior Art

The use of tankless or instantaneous water heaters is known. These heaters generally provide for rapid heating of water as it flows through the heater only when hot water is demanded, in contrast to other types of heaters that heat water at a relatively slow rate and provide storage for heated water. More specifically, apparatus' heretofore devised and utilized for the purpose of providing instantaneous hot water are known to consist basically of familiar, expected and obvious structural configurations, notwithstanding the myriad of designs encompassed by the prior art which have been developed for the fulfillment of countless objectives and requirements.

By way of example, note U.S. Pat. No. 5,479,558 to White, Jr. et al. directed to a very compact flow-through tankless water heater with flow switch and heater control system.

U.S. Pat. No. 5,438,642 to Posen teaches an instantaneous water heater, including a main body having plural vertical upwardly opening chambers and a plurality of combination heating and chamber partition assemblies.

U.S. Pat. No. 5,325,822 to Fernandez teaches an electric, modular tankless fluids heater having serially connected modules defining the path of the fluid being heated through the heater from inlet to outlet, and with each module having two separate chambers and each chamber having an electric immersion type heating assembly.

U.S. Pat. No. 5,408,578 to Bolivar teaches a tankless water heater assembly requiring no storage tank and having an entrance chamber and a plurality of heating elements each of which are at least partially segregated by being removably mounted within separate heating chambers.

U.S. Pat. No. 4,970,373 to Lutz et al. teaches an electronic temperature control system for a tankless water heater having a closed loop, electronic temperature control system for a tankless water heater.

U.S. Pat. No. 4,808,793 to Hurko teaches a tankless electric water heater which provides instantaneous hot water output and includes an open-ended folded tubular conduit having a separate metal sheathed immersion heating element inserted into each end of the conduit.

U.S. Pat. No. 4,786,782 to Takai et al. teaches an electric instantaneous water heater with enhanced temperature control having an output hot water pipe extending into a heating tank, and surrounded by a coiled sheath electric heater for heating the water in the tank the outlet pipe extending to the tank bottom and provided with an inlet thereat.

U.S. Pat. No. 4,604,515 to Davidson teaches a tankless electric water heater having a housing with a plurality of separate serially connected heating chambers defining a water flow path from a cold water inlet port to a heated water outlet port, and having each chamber being provided with a separate electric immersion heating element and a separate temperature sensor. The heating element of each chamber is independently controlled by a control system responsive to signals from each of the temperature sensors and the signal produced by an water outlet temperature selector so that the heating element in a chamber is energized only if the sensed water temperature in that chamber is less than the desired outlet water temperature.

U.S. Pat. No. 4,567,350 to Todd, Jr. teaches a compact high flow rate electric instantaneous water heater and includes a plurality of individual heating chambers connected in series flow relationship between a cold water inlet and a hot water outlet and a metallic mixing coil disposed between each adjacent pair of chambers to promote even mixing.

U.S. Pat. No. 4,455,475 to Giorgetti teaches an automatic device for quick heating of liquids having at least two containers having conduits for supplying cold water and each having heating means, and a tank into which warm water is alternatively supplied from outlets of the single containers.

U.S. Pat. No. 4,095,087 to Giraud teaches a miniature water heater system having electric immersion heaters in a heating enclosure which forms a compact monoblock composite unit resistant to high pressures. Several horizontal tubes are connected at or near their ends by two vertical distributing tubes, one of which is upwardly extended by a circulating pump and the other by a water-mixing turbulator.

U.S. Pat. No. 3,968,346 to Cooksley teaches a compact, fast acting tankless heater having an elongated casing with water inlet and outlet conduits at opposite ends and an elongated generally helically twisted inner tube disposed coaxially within the casing to define helical channel means between the tube and casing for conducting water longitudinally from the casing inlet to the casing outlet. An elongated electric heating means is disposed within the inner tube for heating the water therein.

In this respect, the instantaneous water heater according to the present invention substantially departs from the conventional concepts and designs of the prior art, and in doing so provides an instantaneous water heater, said instantaneous water heater of the present invention as claimed not being described by the above patents, taken either singly or in combination.

Therefore, it can be appreciated that there exists a continuing need for new and improved instantaneous water heater. In this regard, the present invention substantially fulfills this need.

SUMMARY OF THE INVENTION

In view of the foregoing disadvantages inherent in the known types of instantaneous water heater apparatus now present in the prior art, the present invention provides an improved construction and apparatus. As such, the general purpose of the present invention, which will be described subsequently in greater detail, is to provide a new and improved instantaneous water heater which has all of the advantages of the prior art and none of the disadvantages.

To attain this, the new and improved instantaneous water heater of the present invention comprises a tank, said tank being a sealed enclosure and having a top portion, a bottom portion, a first end, and a second end. The tank has an inlet, said inlet conducting unheated water into said tank and being located in said bottom portion of said first end of said tank. The tank has a baffle tube, said baffle tube attaching to said inlet and conducting unheated water from said inlet to said top portion of said second end of said tank. The tank has a baffle, said baffle segregating said tank into a baffle chamber and a main heating and storage chamber. The baffle chamber receives unheated water from said baffle tube and is located in said top portion of said second end of said tank.

The baffle has baffle openings, said baffle openings being between said baffle chamber and said main heating and storage chamber and providing for intermixing of water therebetween. The tank has a plurality of heating elements, said plurality of heating elements being located in apertures located in said first end of said tank. The tank has a plurality of temperature sensors and activators, said plurality of temperature sensors and activators being located on the exterior of said second end of said tank, immediately exterior of said baffle chamber. The main heating and storage chamber has an outlet and a safety valve, said outlet discharging heated water from said tank and being located in said top portion of said first end of said tank, and said safety valve preventing over pressurization in said tank and being located in said outlet.

There has thus been outlined, rather broadly, the more important features of the new and improved instantaneous water heater of the present invention in order that the detailed description thereof that follows may be better understood, and in order that the present contribution to the art may be better appreciated. There are, of course, additional features of the new and improved instantaneous water heater of the present invention that will be described hereinafter and which will form the subject matter of the claims appended hereto.

In this respect, before explaining at least one embodiment of the new and improved instantaneous water heater of the present invention in detail, it is to be understood that the new and improved instantaneous water heater of the present invention is not limited in its application to the details of construction and to the arrangements of the components set forth in the following description or illustrated in the drawings. The new and improved instantaneous water heater of the present invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the new and improved instantaneous water heater of the present invention. It is important, therefore, that the claims be regarded as including such equivalent construction insofar as they do not depart from the spirit and scope of the new and improved instantaneous water heater of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection of the nature and essence of the technical disclosure of the application. The abstract is neither intended to define the invention of the application, which is measured by the claims, nor is it intended to be limiting as to the scope of the new and improved instantaneous water heater of the present invention in any way.

It is therefore an object of the present invention to provide a new and improved instantaneous water heater which may be easily, readily and safely placed in either an "open" or "closed" water system and has all of the advantages of the prior art and none of the disadvantages.

It is another object of the present invention to provide a new and improved instantaneous water heater which heats water only when hot water is demanded.

It is another object of the present invention to provide a new and improved instantaneous water heater which provides sufficient minimal water storage within such unit to absorb water heating and the energy of the heated water therein after such water heating has been discontinued.

It is another object of the present invention to provide a new and improved instantaneous water heater wherein energization of heating elements is sequentially accomplished based upon threshold temperature sensors.

It is another object of the present invention to provide a new and improved instantaneous water heater which may be easily and efficiently manufactured and marketed.

It is another object of the present invention to provide a new and improved instantaneous water heater which is of a durable and reliable construction.

It is another object of the present invention to provide a new and improved instantaneous water heater which is susceptible of a low cost of manufacture with regard to both material and labor and which accordingly is susceptible of low prices of sale to the consuming public, thereby making such a new and improved instantaneous water heater economically available to the buying public.

These together with other objects of the new and improved instantaneous water heater of the present invention, along with the various features of novelty which characterize the new and improved instantaneous water heater of the present invention, are pointed out with particularity in the claims annexed to and forming a part of this disclosure. For a better understanding of the new and improved instantaneous water heater of the present invention, its operating advantages and the specific objects attained by its uses, reference should be had to the accompanying drawings and descriptive matter in which there is illustrated preferred embodiments of the new and improved instantaneous water heater of the present invention.

BRIEF DESCRIPTION OF THE DRAWINGS

The new and improved instantaneous water heater of the present invention will be better understood and objects other than those set forth above will become apparent when consideration is given to the following detailed description thereof. Such description makes reference to the annexed drawings wherein.

DESCRIPTION OF THE PREFERRED EMBODIMENT

While the new and improved instantaneous water heater of the present invention will be described more fully with reference to the accompanying drawings, in which particular embodiments are shown, it is to be understood at this outset that persons skilled in the art may modify the new and improved instantaneous water heater of the present invention while still achieving the favorable results of the invention. Accordingly, the description which follows is to be understood as a broad teaching disclosure directed to persons of skill in the appropriate arts and not as limiting upon the new and improved instantaneous water heater of the present invention.

Figure 1:
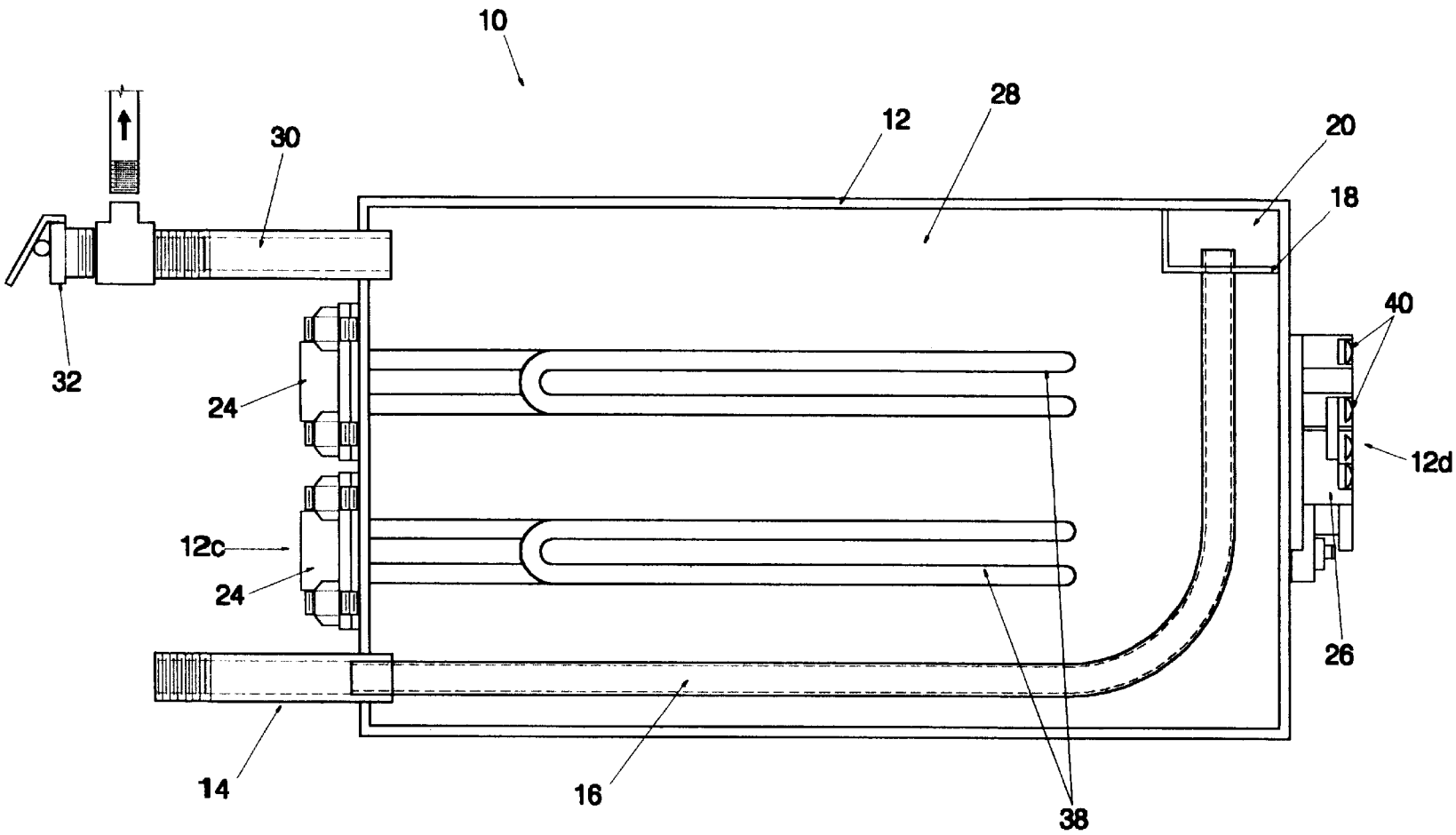
FIG. 1 is a side perspective view of the instantaneous water heater of the present invention.
Figure 2:
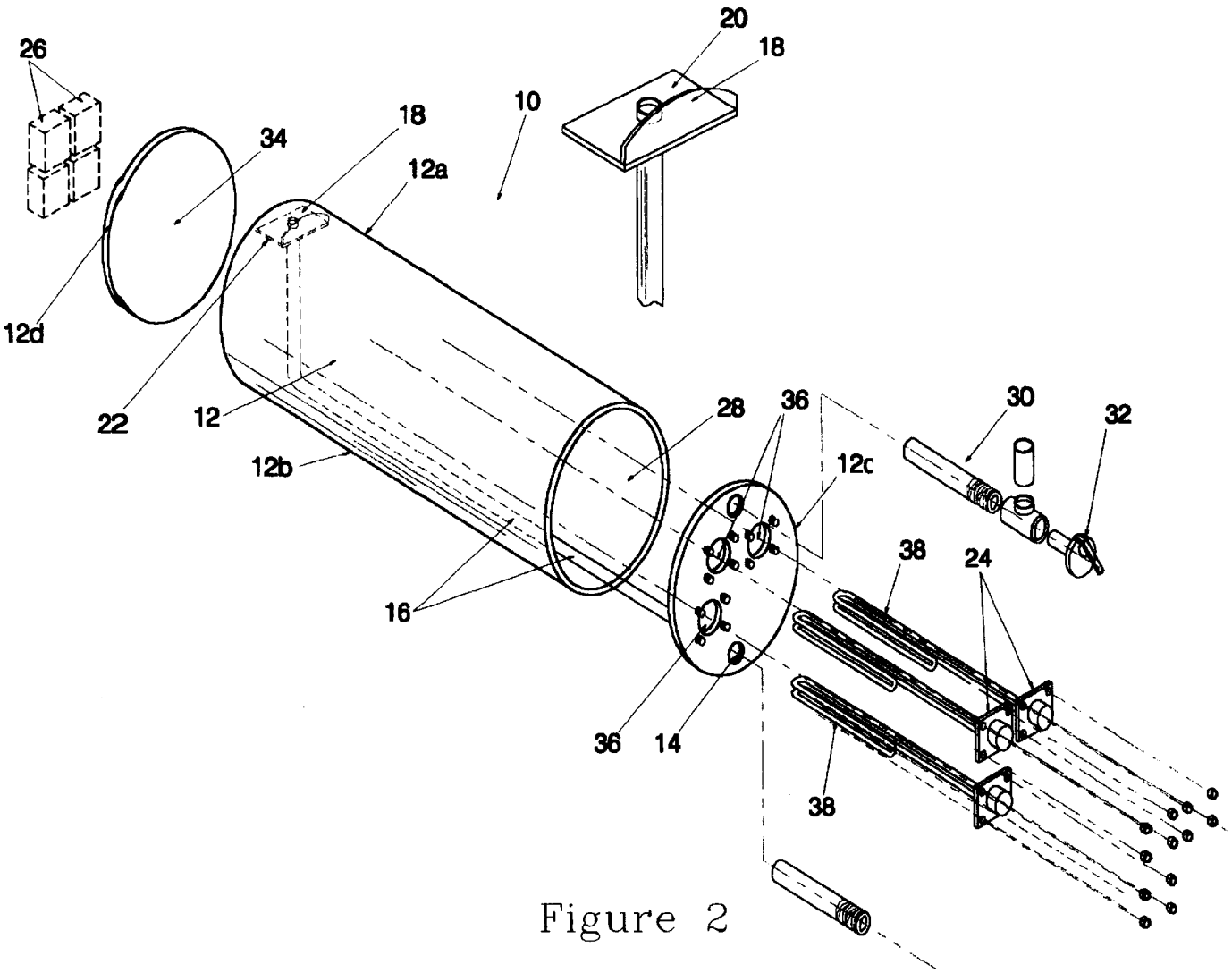
FIG. 2 is an exploded view of the instantaneous water heater of the present invention showing the components thereof.
Figure 3:
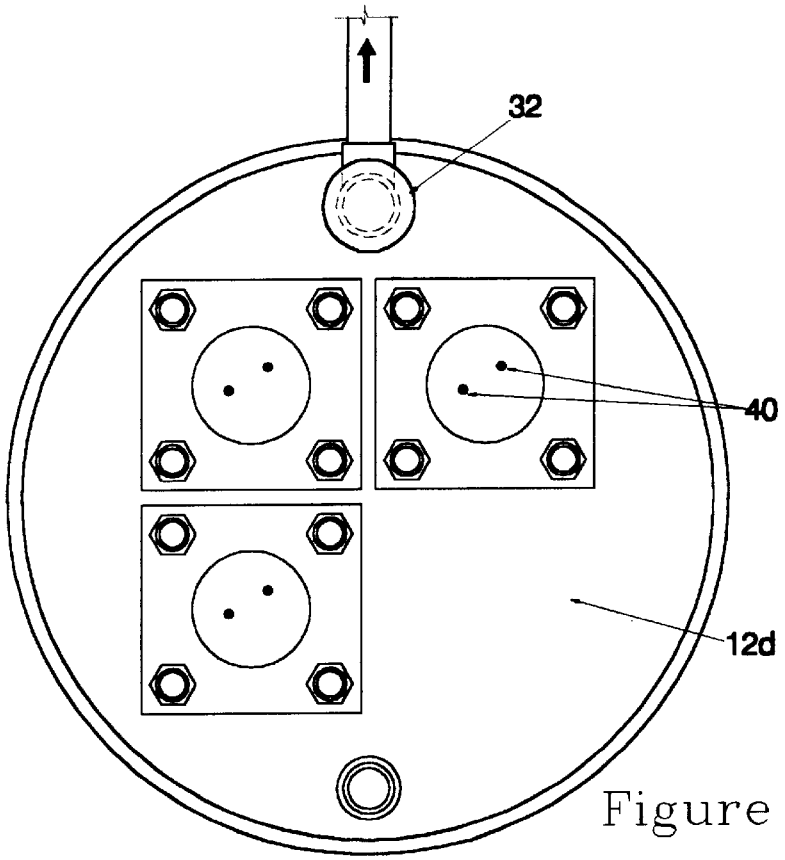
FIG. 3 is an end view of the instantaneous water heater of the present invention showing the placement of the heating elements therein.
Figure 4:
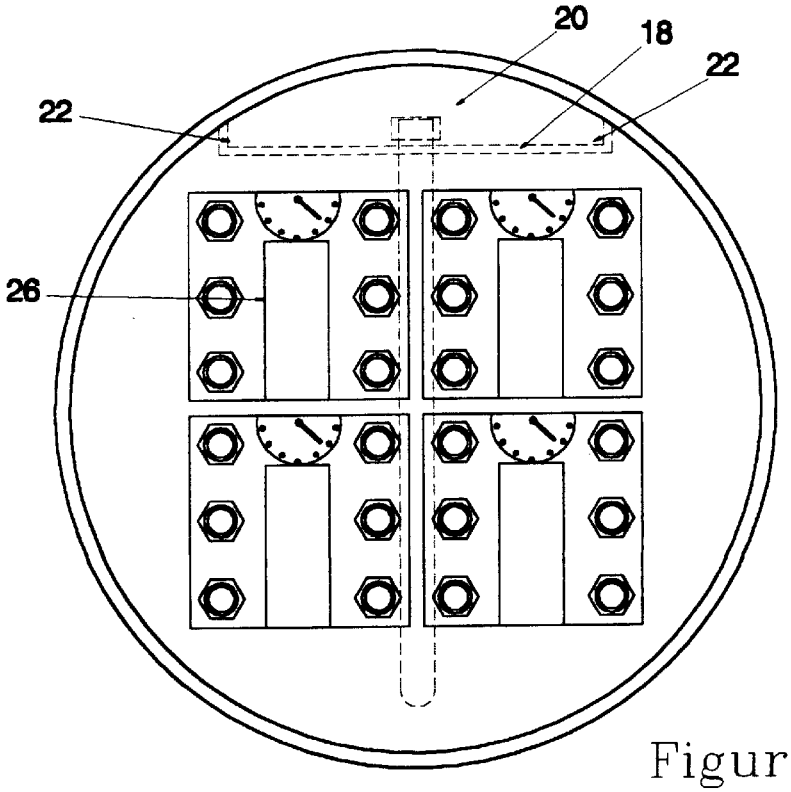
FIG. 4 is an end view of the instantaneous water heater of the present invention showing the placement of the temperature sensors and activators therein

With reference now to the drawings, and as shown in FIGS. 1 through 4 thereof, a new and improved instantaneous water heater embodying the principals and concepts of the present invention and generally designated by the reference numeral 10 will be described.

The new and improved instantaneous water heater 10 of the present invention is seen in FIGS. 1 through 4, although not including an outer support housing, and includes a tank 12 having an inlet 14, a baffle tube 16, a baffle 18, a baffle chamber 20, baffle openings 22, a plurality of heating elements 24, a plurality of temperature sensors and activators 26, a main heating and storage chamber 28, an outlet 30, and a safety valve 32.

Tank 12 optimally contains from one-half (½) to five (5) gallons of water at all times, dependent upon the particular usage for which the instantaneous water heater 10 is intended to be used, with three (3) gallons being generally appropriate for most usages. In use, the tank 12 always retains a volume of water, which water remains at an established minimum temperature, as further described hereinbelow. The water stored in the tank 12 provides instant heated water upon demand. The water stored in the tank 12 further provides a reservoir of heated water to mix with and raise the temperature of the incoming water. The temperature of the incoming water is raised as the heating elements are initially activated upon the demand for heated water, and thus provides for instantaneously heated water leaving the tank 12. The tank 12 is constructed of strong durable material such as welded 316 L stainless steel sufficient to withstand the pressure and corrosive effects of heated water and may be configured as a round, tubular tank, a square tank or a rectangular tank. In one embodiment, a second end 12*d* may be constructed of copper or other such highly temperature conductive material.

In all physical shape configurations, the tank 12 is a sealed enclosure and has a top portion 12*a*, a bottom portion 12*b*, a first end 12*c*, and a second end 12*d* which provide for specific functional relationship of the other elements of the instantaneous water heater 10. The tank 12 has an inlet 14 by which cold water enters the instantaneous water heater 10. The inlet 14 is located in the bottom portion 12*b* of the first end 12*c* of the tank 12. The inlet 14 is of a size to accommodate an incoming water supply (not shown). The inlet 14 is secured to the tank 12 in sealed manner, such as welding.

The inlet 14 is securely attached to a baffle tube 16 in the interior of the tank 12. The baffle tube 16 extends from the inlet 14 the length of the tank 12 to the top portion 12*a* of the second end 12*d* of the tank 12. At the top portion 12*a* of the second end 12*d* of the tank 12, the baffle tube 16 opens into a baffle chamber 20. The baffle tube 16 transports incoming water from the inlet 14 into the baffle chamber 20.

The baffle chamber 20 is created in the interior top portion 12*a* at the second end 12*d* of the tank 12 by means of a baffle 18. The baffle 18 is a semi-partition of the interior top portion 12*a* of the second end 12*d* of the tank 12. The baffle 18 has baffle openings 22 on the sides of the semi-partition into the interior of the tank 12. The baffle openings 22 on the sides of the semi-partition allow water incoming into the baffle chamber 20 from the baffle tube 16 to exit the baffle chamber 20 into the main heating and storage chamber 28 of the tank 12. The incoming water is thus directed from the baffle chamber 20 down the sides of the interior of the tank 12 into the main heating and storage chamber 28 of the tank 12 allowing the incoming water to be commingled, mixed and further heated with the water in the main heating and storage chamber 28 of the tank 12 and thus prevent what is commonly known as "streaming".

On the exterior of the second end 12*d* of tank 12 are located a plurality of one (1) to four (4) temperature sensors and activators 26. The plurality of temperature sensors and activators 26 are located on the exterior of the second end 12*d* of tank 12 directly adjacent the baffle tube 16 exit exits in the interior of tank 12. Such location of the plurality of temperature sensors and activators 26 allows the temperature sensors and activators 26 to immediately register the temperature of the water incoming into the main heating and storage chamber 28 from the baffle tube 16.

The first end 12*c* of the tank 12 has apertures 36 for removably attaching in sealed manner a plurality of one (1) to four (4) electric heating elements 24. The plurality of heating elements 24 are removably attached to the first end 12*c* of the tank 12 such that the heating element cores 38 of the heating elements 24 are located within the interior of the tank 12 and the electrical contacts 40 are located on the outside of the first end 12*c* of the tank 12.

The plurality of heating elements 24 are electrically connected one each to one each of the plurality of temperature sensors and activators 26. The plurality of temperature sensors and activators 26 are preset to activate at certain temperatures and are each individually connected to one each of the plurality of heating elements 24. For example, a first temperature sensor and activator 26 may be preset to activate when the ambient water temperature in the baffle chamber 20 is at a certain temperature, for example 115 F. When the ambient water temperature of the water in the baffle chamber 20 is at 115 F., the first temperature sensor and activator 26 will be deactivated, shutting off power to a first heating element 24. But, when the ambient water temperature in the baffle chamber 20 falls below 115 F., the first temperature sensor and activator 26 will activate and energize the first heating element 24 causing the first heating element 24 to heat the water in the main heating and storage chamber 28 of the tank 12 until the first temperature sensor and activator 26 again senses that the ambient temperature of the water in the baffle chamber 20 is at 115 F. The remaining plurality of temperature sensors and activators 26 can be preset to activate at a temperature lower than of the first temperature sensor and activator 26, such as at 110 F. By such presetting of all of the temperature sensors and activators 26, when the ambient temperature of the water in the baffle chamber 20 is between 110 F. and 115 F., only the first temperature sensor and activator 26 will be activated and only the first heating element 24 will be heating the water in the main heating and storage chamber 28 of the tank 12. But, when the ambient temperature of the water in the baffle chamber 20 falls below 110 F., such as when heated water is being demanded, the other temperature sensors and activators 26 will be activated thus energizing the other heating elements 24 to raise the temperature of the water in the main heating and storage chamber 28. The temperature sensors and activators 26 may be preset sequentially to sense and activate individually at different temperatures or may be preset to sense and activate as groups dependent upon the application desired. It will be appreciated that the electrical components employed herein are well known within the art, are readily available, and need not be explained in detail herein.

The tank 12 has an outlet 30 by which heated water exits the instantaneous water heater 10. The outlet 30 is located in the top portion 12*a* of the fist end 12*c* of the tank 12. The outlet 30 is of a size to accommodate hot water distribution plumbing (not shown). The outlet 30 is secured to the tank 12 in sealed manner, such as welding. The outlet 30 further has attached thereto a temperature and pressure activated safety valve 32.

As to the manner of usage and operation of the new and improved instantaneous water heater 10, the instantaneous water heater 10 is securely attached to an incoming water supply at the inlet 14 and to a hot water distribution pipe at the outlet 30. The tank 12 is filled to capacity and the temperature sensors and activators 26 are connected to a standard electrical source. The temperature sensors and activators 26 sense the ambient temperature of the water in the baffle chamber 20 and if the ambient temperature of the water stored in the baffle chamber 20 is below a preset temperature, the temperature sensors and activators 26 energize the heating elements 24 to raise the ambient temperature of the water in the tank 12, and thus the baffle chamber 20 to a certain preset temperature at which time the temperature sensors and activators 26 will deactivate thus de-energizing the heating elements 24. The ambient temperature in the tank 12 will be maintained by one of the temperature sensors and activators 26 having a preset temperature higher than the other temperature sensors and activators 26.

When heated water is demanded, the water at the ambient temperature in the main heating and storage chamber 28 of the tank 12 is drawn out the outlet 30, and incoming water enters the inlet 14 into the baffle tube 16 and exits the baffle tube 16 into the baffle chamber 20 immediately adjacent to the temperature sensors and activators 26. The relatively cooler temperature of the incoming water being discharged from the baffle tube 16 against the interior sides of the tank 12 in the baffle chamber 20 immediately adjacent to the temperature sensors and activators 26 activates the temperature sensors and activators 26 which in turn energize the heating elements 24 in the main heating and storage chamber 28 of the tank 12. The incoming relatively cooler water in the baffle chamber 20 is discharged from the baffle chamber 20 through the baffle openings 22 into the main heating and storage chamber 28 of the tank 12, which baffle openings 22 force the relatively cooler water being discharged from the baffle chamber 20 down both of the interior sides of the tank 12 mixing the relatively cooler water with the heated water in the main heating and storage chamber 28 of the tank 12 at the second end 12*d* of the tank 12. This manner of mixing the relatively cooler incoming water with the heated water at the second end 12*d* of the tank 12, the end away from the outlet 30, causes uniform mixing between the differing temperature water and results in heated water at a constant temperature exiting from the outlet 30.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principals of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed and desired to be secured by United States Letters Patent is:

1. An instantaneous water heater comprising:

a tank, said tank being a sealed enclosure and having a top portion, a bottom portion, a first end, and a second end;

an inlet, said inlet conducting unheated water into said tank and being located in said bottom portion of said first end of said tank;

a baffle tube, said baffle tube attaching to said inlet and conducting unheated water from said inlet to said top portion of said second end of said tank;

a baffle, said baffle segregating said tank into a baffle chamber and a main heating and storage chamber;

said baffle chamber receiving unheated water from said baffle tube and being located in said top portion of said second end of said tank;

said baffle having baffle openings, said baffle openings being between said baffle chamber and said main heating and storage chamber and providing for intermixing of water therebetween;

a plurality of heating elements, said plurality of heating elements being located in apertures located in said first end of said tank;

a plurality of temperature sensors and activators, said plurality of temperature sensors and activators being located on the exterior of said tank at said second end;

said main heating and storage chamber having, an outlet and a safety valve;

said outlet discharging heated water from said tank and being located in said top portion of said first end of said tank; and, said safety valve preventing over-heating and over-pressurization in said tank and being attached to said outlet.

2. An instantaneous water heater as claimed in claim 1 wherein said tank further comprises a tank having a capacity of one-half (½) to five (5) gallons of water.

3. An instantaneous water heater as claimed in claim 2 wherein said plurality of temperature sensors and activators further comprise one to four temperature sensors and activators.

4. An instantaneous water heater as claimed in claim 3 wherein said plurality of electric heating elements further comprise one to four electric heating elements.

5. An instantaneous water heater as claimed in claim 4 wherein said tank further comprises a tank constructed of welded 316 L stainless steel.

6. An instantaneous water heater as claimed in claim 5 wherein said second end further comprises copper.

7. An instantaneous water heater as claimed in claim 6 wherein said tank further comprises a tank configured as a round, tubular tank.

8. An instantaneous water heater as claimed in claim 6 wherein said tank further comprises a square tank.

9. An instantaneous water heater as claimed in claim 6 wherein said tank further comprises a rectangular tank.

10. An instantaneous water heater as claimed in claim 5 wherein said inlet and said outlet are welded to said tank.

* * * * *